US009500346B2

(12) United States Patent
Iannello et al.

(10) Patent No.: US 9,500,346 B2
(45) Date of Patent: Nov. 22, 2016

(54) LIGHT DISPERSING FLASHLIGHT COVER

(71) Applicant: ILLINOIS TOOL WORKS INC., Glenview, IL (US)

(72) Inventors: Christopher A. J. Iannello, Rolling Meadows, IL (US); Jon D. Burrow, Bartlett, IL (US)

(73) Assignee: ILLINOIS TOOL WORKS INC, Glenview, IL (US)

( * ) Notice: Subject to any disclaimer, the term of this patent is extended or adjusted under 35 U.S.C. 154(b) by 265 days.

(21) Appl. No.: 14/372,474

(22) PCT Filed: Jan. 16, 2013

(86) PCT No.: PCT/US2013/021687
§ 371 (c)(1),
(2) Date: Jul. 16, 2014

(87) PCT Pub. No.: WO2013/109594
PCT Pub. Date: Jul. 25, 2013

(65) Prior Publication Data

US 2015/0055333 A1 Feb. 26, 2015

Related U.S. Application Data

(60) Provisional application No. 61/587,950, filed on Jan. 18, 2012.

(51) Int. Cl.

| | |
|---|---|
| ***F21V 17/16*** | (2006.01) |
| ***F21V 5/00*** | (2015.01) |
| ***F21V 17/00*** | (2006.01) |
| ***F21L 4/04*** | (2006.01) |

(Continued)

(52) U.S. Cl.
CPC ..... *F21V 17/164* (2013.01); *F21L 4/045* (2013.01); *F21V 5/006* (2013.01); *F21V 17/002* (2013.01); *F21L 15/02* (2013.01); *F21W 2111/10* (2013.01)

(58) Field of Classification Search
CPC .. F21V 21/0885; F21V 21/088; F21V 15/02; F21V 15/04; F21V 11/16; F21V 11/18; F21V 7/0075; F21V 1/06; F21V 1/08; F21V 14/08; F21V 17/107; F21V 17/002; F21V 17/06; F21L 15/02; F21L 15/04
USPC ..... 362/166
See application file for complete search history.

(56) References Cited

U.S. PATENT DOCUMENTS 1,274,713 A * 8/1918 Hoffman et al. ..... F21L 7/00 362/200
2,137,881 A * 11/1938 Margulies ..... A45D 42/10 248/480

(Continued)

FOREIGN PATENT DOCUMENTS

DE 20206201 U1 9/2002
WO 2008/085695 A1 7/2008

OTHER PUBLICATIONS

ISR and WO for PCT/US2013/021687 mailed Apr. 26, 2013.

*Primary Examiner* — Robert May
*Assistant Examiner* — Leah S Macchiarolo
(74) *Attorney, Agent, or Firm* — Paul F. Donovan

(57) ABSTRACT

A light dispersing flashlight cover adapted for selective attachment to a flashlight having an articulating head. The cover includes a platform supported in resilient cantilevered relation such that the platform is disposed in overlying, raised relation to at least a portion of the flashlight lens when the cover is in place. A light beam emitted through the lens is at least partially blocked by the platform and is dispersed radially relative to the lens.

19 Claims, 5 Drawing Sheets

(51) Int. Cl.
*F21V 1/00* (2006.01)
*F21W 111/10* (2006.01)

(56) References Cited

U.S. PATENT DOCUMENTS 4,257,085 A * 3/1981 Kimmel ..... F21L 15/10 362/186
4,739,457 A * 4/1988 Orr ..... F21L 15/02 362/190
5,001,612 A 3/1991 Odlum
5,045,980 A * 9/1991 Harvey ..... F21L 15/02 362/202
2005/0018422 A1 1/2005 Rutkowski
2013/0279157 A1* 10/2013 McDermott ..... F21L 4/005 362/184

* cited by examiner

LIGHT DISPERSING FLASHLIGHT COVER

CROSS REFERENCE TO RELATED APPLICATION

This application is a National Phase of International Application Number PCT/US2013/021687 filed Jan. 16, 2013 and claims the benefit of, and priority from U.S. Provisional Application No. 61/587,950 filed Jan. 18, 2012 the contents of which are incorporated by reference in their entirety as if fully set forth herein.

TECHNICAL FIELD

The present disclosure relates generally to flashlights, and more specifically to a selectively attachable cover for a flashlight adapted to intercept and disperse an emitted light beam in radial directions to broaden the field of illumination.

BACKGROUND

Flashlights are well known. Such devices are useful in providing illumination at night and/or in environments in which a lack of sufficient light reduces visibility. It is also known to use flashlights with articulating heads to permit a user to direct light in a desired direction out of alignment with the flashlight body.

In the past, it has generally been considered to be desirable for a flashlight to project a relatively focused and concentrated beam of light to illuminate areas at a substantial distance from the user. However, in some instances, a user may wish to illuminate a relatively wide area in close proximity. In those circumstances, the highly focused beam of light may have reduced utility. Moreover, it may be desirable for a user to be able to switch between a focused and a dispersed light beam using a single flashlight without undue complexity.

In light of the above, a need exists for a device which may be used to adjust existing flashlights between a focused light beam and a radially dispersed illumination pattern so as to provide the user with enhanced options during use. Such a device should also avoid interference with articulating motion of a flashlight head adapted to rotate about a defined axis.

SUMMARY OF THE DISCLOSURE

The present disclosure provides advantages and alternatives over the prior art by providing a selectively attachable cover adapted for attachment to an articulating flashlight. The cover includes a beam intercepting panel configured to be in raised, spaced-apart relation to the flashlight head in the attached condition. Radial slot openings are disposed between the beam intercepting panel and the flashlight head when the cover is in the attached condition. With the cover in the attached position, a light beam emitted from the flashlight head is intercepted by the overlying panel and at least a portion of the light is dispersed radially outwardly through the slot openings thereby providing an enhanced diameter field of illumination.

In accordance with one exemplary aspect, the present disclosure provides a light dispersing flashlight cover adapted for selective attachment to a flashlight having an articulating head and a barrier wall disposed about a lens. The cover includes a support collar adapted to matedly engage a distal portion of the barrier wall extending radially outwardly from the lens such that the distal portion of the barrier wall projects through the support collar. The cover further includes a platform extending away from the support collar. The platform is supported in resilient cantilevered relation to the support collar and extends away from the support collar such that the platform is disposed in overlying, raised relation to at least a portion of the lens when the support collar matedly engages the distal portion of the barrier wall. A light beam emitted through the lens is at least partially blocked by the platform and is dispersed radially relative to the lens.

Other features and advantages of the disclosure will become apparent to those of skill in the art upon review of the following detailed description, claims and drawings.

Figure 1:
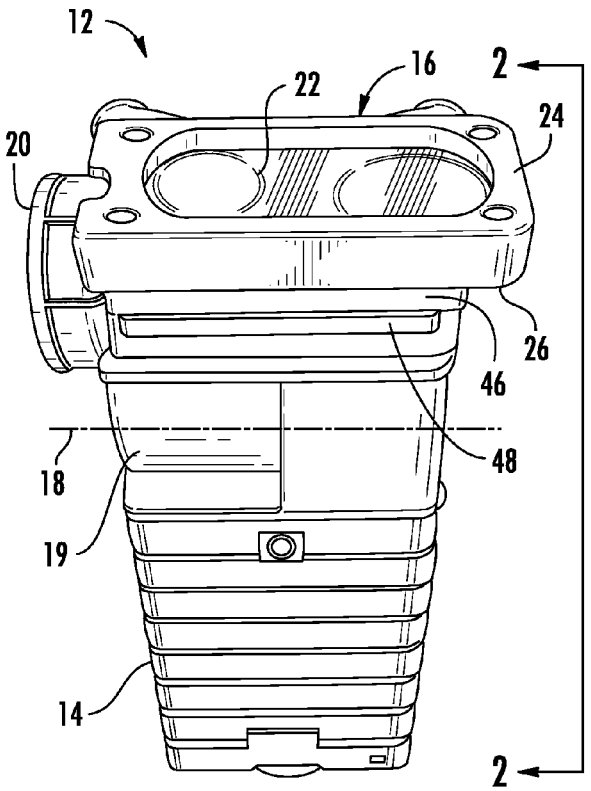
FIG. 1 is an elevation perspective view of an exemplary articulating head flashlight suitable for engagement with a light dispersing cover in accordance with the present disclosure.

Before exemplary embodiments of the disclosure are explained in detail, it is to be understood that the disclosure is in no way limited in its application or construction to the details and the arrangements of the components set forth in the following description or illustrated in the drawings. Rather, the disclosure is capable of other embodiments and being practiced or being carried out in various ways.

DETAILED DESCRIPTION OF THE PREFERRED EMBODIMENTS

The present disclosure will now be described more fully with reference to accompanying drawings in which exemplary embodiments are illustrated. However, the present disclosure is in no way limited to such illustrated embodiments and numerous other forms may be used.

Figure 2:
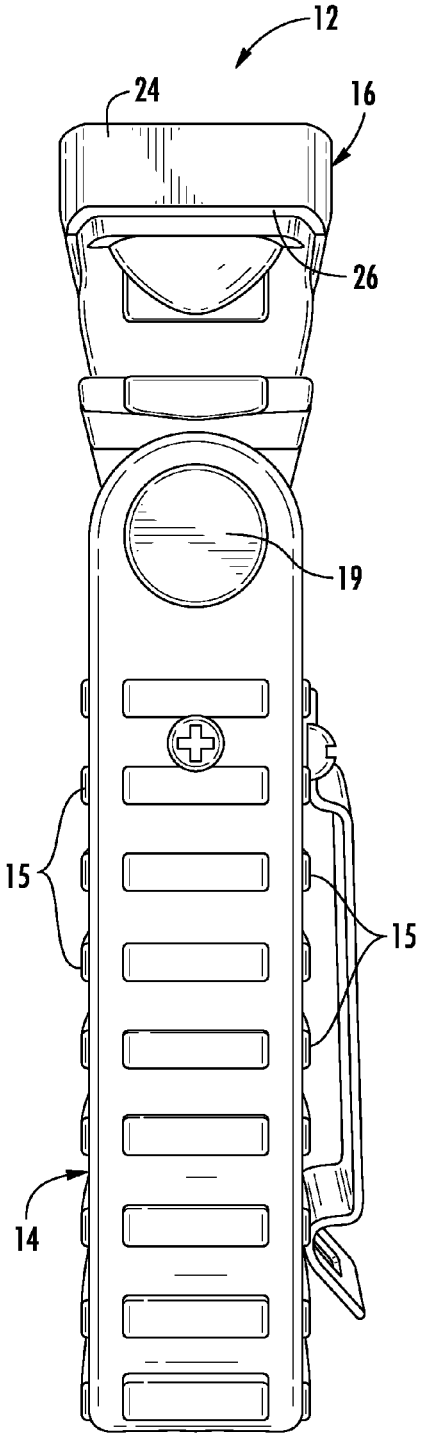
FIG. 2 is an edge view of an exemplary articulating head flashlight taken generally along line 2-2 in FIG. 1.

Referring now to the figures, FIGS. 1 and 2 illustrate a flashlight 12 as will be well known to those of skill in the art. As shown, the exemplary flashlight 12 includes a body 14 which may include a pattern of ridges 15 or other surface contours as may be desired to assist a user in holding the body 14. An articulating head 16 having a generally wedge-shaped configuration is adapted to rotate relative to the body around a pivot axis 18. By way of example only, and not limitation, the pivot axis 18 may be defined by a rotatable hub 19 operatively connected to the head 16 and rotatably mounted within the body below the head 16 in a manner as will be well known to those of skill in the art.

As will be appreciated by those of skill in the art, during use the head 16 may rotate through an angle of approximately 180 degrees such that a beam of light may be emitted either in substantial alignment with the body 14, at substantially right angles to the body, or at intermediate angles relative to the body 14. In this regard, the light beam may be activated by depressing a push-button on/off switch 20 disposed at one end of the head 16. During normal operation, upon activating the switch 20, light is discharged from light emitting elements and through a translucent covering lens 22 for projection onto a distant surface to be illuminated. Various levels of illumination may be achieved by using the switch to selectively activate more or fewer light emitting elements.

As best illustrated in FIGS. 1 and 2, the head 16 may include a perimeter barrier wall 24 disposed in surrounding relation to the covering lens 22. As shown, the barrier wall 24 may extend radially outwardly from the covering lens and may also project above and below the plane defined by the covering lens 22. The barrier wall 24 thus acts to protect the covering lens 22 from damage in the event of impact. As best seen in FIG. 1, the distal end of the barrier wall 24 projecting away from the switch 20 may extend outwardly beyond an underlying lateral edge of the body to define a downwardly facing cantilevered shoulder 26. In practice, both the head 16 and the body 14 may be formed from similar high impact plastic materials. However, different materials also may be used if desired.

As best illustrated through joint reference to FIGS. 3-6, the present disclosure provides a cover 28 (FIG. 3) adapted to slidingly engage the head 16. The cover 28 is preferably a unitary structure molded from a high impact polymer which may be the same or similar to the material forming the flashlight body 14. In the illustrated exemplary construction the cover 28 includes a cantilevered platform 30 defining a leaf spring extending away from a support collar 32. As shown, the support collar 32 may include a pair of opposing lateral posts extending between a proximal end of the platform 30 and a lower crossing support. The perimeter boundaries of the support collar 32 cooperatively define an opening adapted to matedly receive the distal end of the barrier wall 24 as the cover slides into place (FIG. 6) in a manner as will be described more fully hereinafter. As shown, a pattern of collar indentations 33 may be disposed along the exterior surface of the collar 32. Such collar indentations 33 may be useful in reducing the mass of material used in forming the cover 28 while also aiding a user in gripping the structure during use.

In accordance with the illustrated exemplary construction, the platform 30 may have a contoured surface profile with a pattern of alternating depressions 34 and raised ribs 36 extending along the opposing lateral sides of the platform. As shown, the depressions 34 and raised ribs 36 are disposed along the border of a central interior panel 38 extending generally along the length dimension of the platform 30. As will be appreciated, the pattern of alternating depressions 34 and raised ribs 36 extending away from lateral sides of the interior panel 38 may be useful in promoting flexibility of the platform 30 without diminishing strength. Of course, it is likewise contemplated that such structures may be eliminated if desired. Regardless of the actual surface profile, the cantilevered platform is preferably sufficiently resilient to permit flexing in a spring-like manner at the intersection with the support collar 32 without undergoing permanent deformation during engagement with the head 16 as the cover is being attached (FIG. 6).

Figure 4:
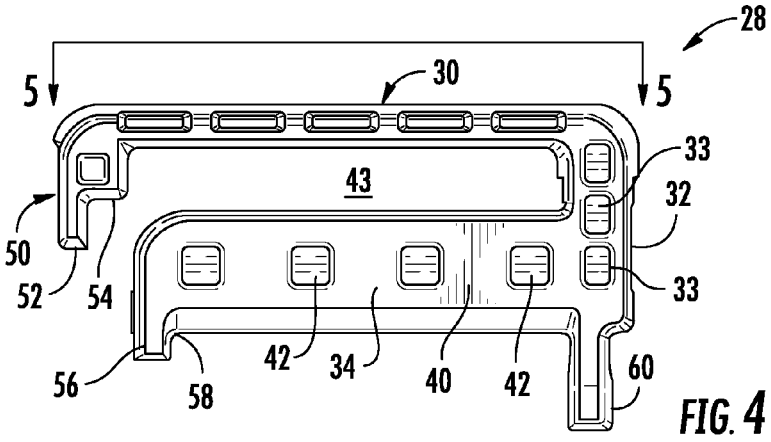
FIG. 4 is a side view of the exemplary light dispersing cover of FIG. 3.
Figure 5:
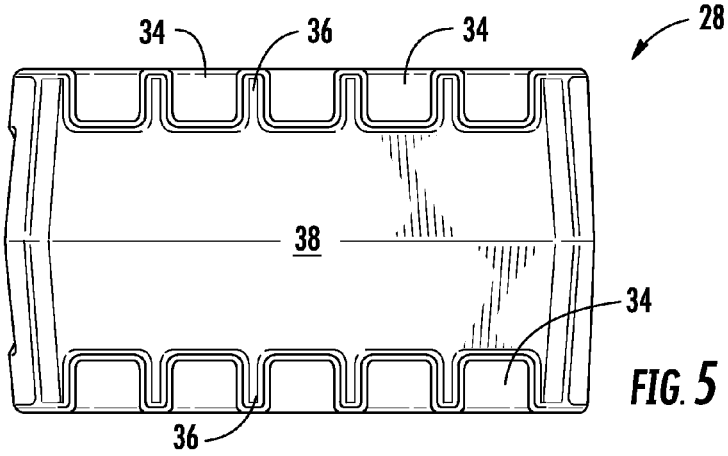
FIG. 5 is a top view of the exemplary light dispersing cover of FIG. 3 taken generally along line 5-5 in FIG. 4.

In the illustrated exemplary construction, a pair of lateral rail legs 40 extends away from the support collar 32 at a position below the platform 30 and in generally parallel relation to the platform 30. As shown, a pattern of leg indentations 42 may be disposed along the exterior surface of the rail legs 40. Such leg indentations 42 may be useful in reducing the mass of material used in forming the cover 28 while also aiding a user in gripping the structure during use. The rail legs 40 are disposed below the platform 30, such that there is a perimeter gap 43 between the rail legs 40 and the edge of the platform 30 on either lateral side of the cover (FIG. 4).

In the illustrated exemplary embodiment, a pair of ears 44 project radially inwardly from opposing sides of the lateral posts of the support collar 32. As shown, the ears 44 may be disposed at an elevation between the platform 30 and the rail legs 40. By way of example only, the ears 44 may have a generally flat geometry with a curved distal end. However, other constructions may likewise be used if desired. Regardless of their construction, the ears 44 are preferably adapted to ride within grooves 46 extending along opposing sides of the head 16 in substantially parallel relation to the pivot axis 18 (FIG. 1). As best seen in FIG. 1, the grooves 46 (only one shown) may be defined by the zone between the lower edge of the barrier wall 24 and a molded-in ridge 48 disposed below the bather wall with such a pattern duplicated on both sides of the head 16. In this regard, the distance between the molded-in ridge 48 and the opposing lower edge of the barrier wall 24 may substantially match the thickness of the ears 44. With such a complementary arrangement, the ears 44 may be held in a relatively tight, sliding relationship within the grooves 46.

Figure 6:
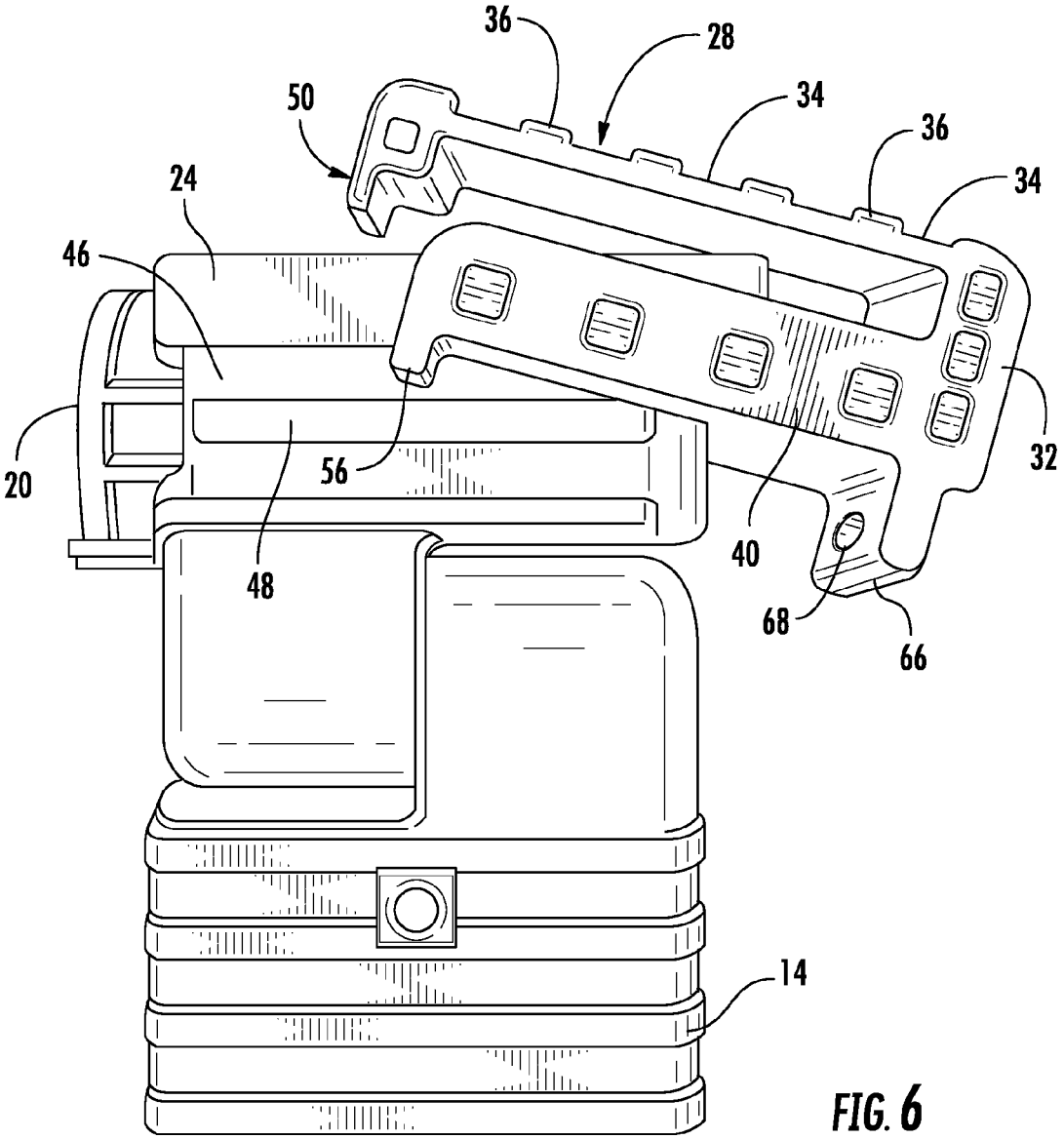
FIG. 6 is a schematic view illustrating an intermediate state of engagement between the exemplary flashlight of FIG. 1 and the exemplary cover of FIG. 3.
Figure 7:
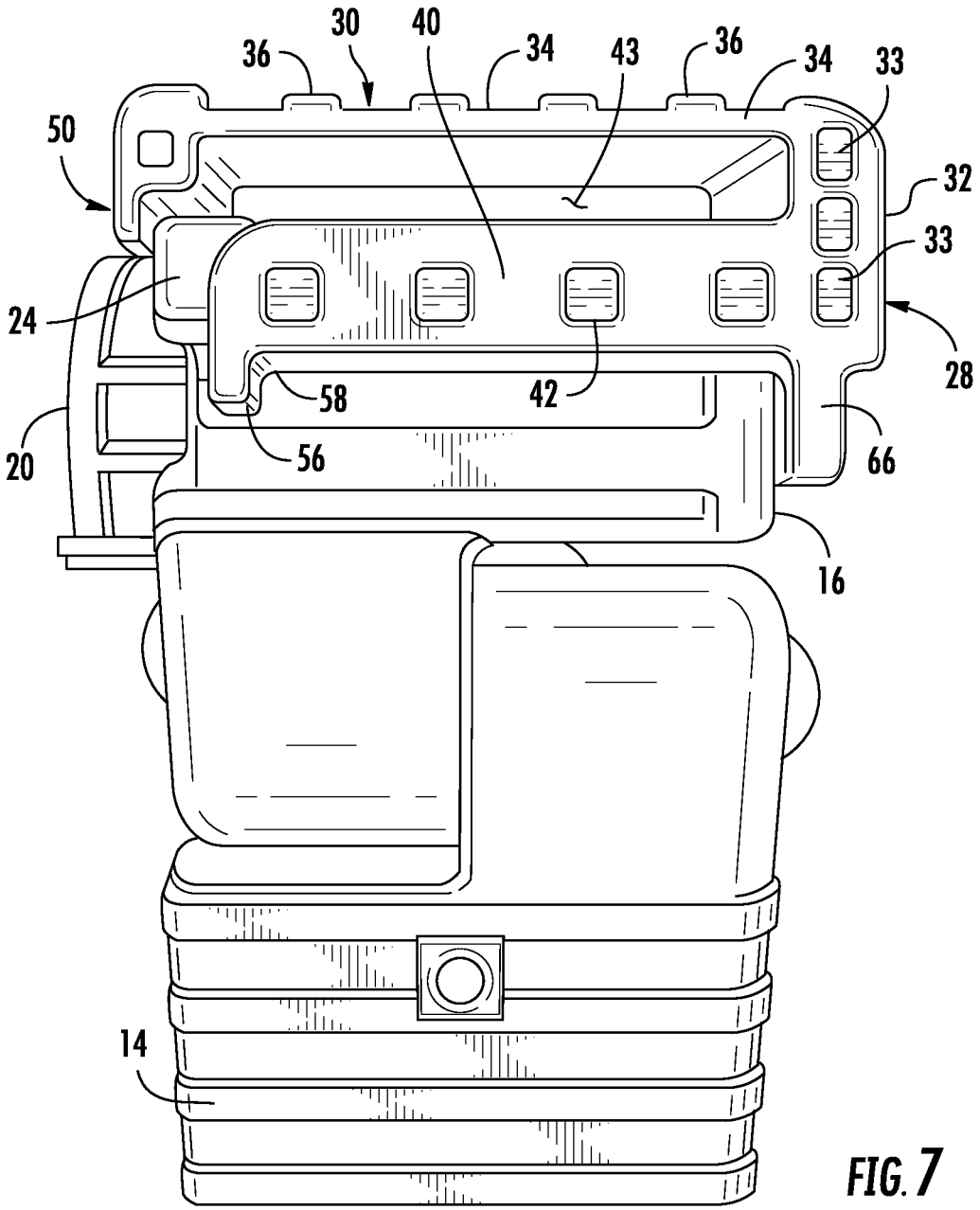
FIG. 7 is a view similar to FIG. 6 with the exemplary cover in the attached condition on the exemplary flashlight.

As will be appreciated, through reference to FIGS. 6 and 7, during installation of the cover 28 to the flashlight head 16, the engagement between the ears 44 and the corresponding grooves 46 on opposite sides of the head may aid in guiding the cover into position relative to the head 16 in a sliding action. Moreover, once the cover 28 is in place, the ears 44 will be held in a tongue-in-groove relationship which blocks against unintended displacement after connection unless a reverse sliding action takes place. That is, the cover 28 can only be removed by conducting an intentional reverse sliding action.

Figure 3:
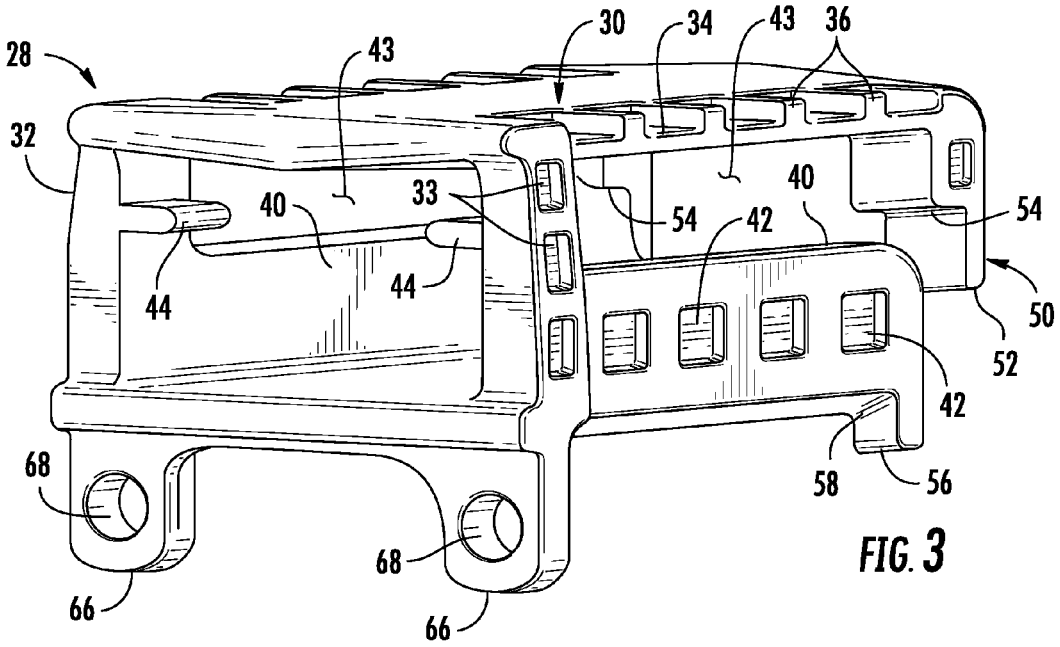
FIG. 3 is a perspective isometric view illustrating an exemplary light dispersing cover consistent with the present disclosure.

As shown, in the exemplary embodiment a pair of downwardly projecting catch arms 50 extends downwardly away from the corners at the free end of the platform 30. As best seen in FIGS. 3 and 4, in the exemplary construction the catch arms 50 each may have a generally zig-zag interior surface with a finger 52 forming a free end extending away from a shoulder 54 defining an undercut surface.

As best seen through joint reference to FIGS. 6 and 7, during the attachment process, the platform 30 may flex upwardly in a spring-like manner to accommodate the introduction of the head 16. When the insertion is completed with a distal end of the barrier wall 24 extending into the support collar 32, the spring action of the platform 30 causes the catch arms 50 to snap over the proximal edge of the barrier wall 24. In this condition, the fingers 52 are disposed adjacent to the proximal edge of the barrier wall with the shoulders 54 resting on top of the proximal edge. As will be appreciated, this condition is maintained by the resilient spring-like action of the platform pressing down on the top of the barrier wall. In this condition, withdrawal of the cover 28 by sliding reversal is blocked by the interference between the fingers 52 and the barrier wall 24. Moreover, a distal end of the barrier wall 24 may extend at least partially through the support collar 32 with the ears 44 held in corresponding grooves 46 on the head 16 such that the cover cannot be pulled off vertically. In the event that removal of the cover is desired, a user may raise the end of the platform 30 to a degree required to eliminate the interference between the fingers 52 and the barrier wall 24. The cover 28 then may be pulled off the head 16 by a reverse sliding action.

As best illustrated through joint reference to FIGS. 3, 6 and 7, in the illustrated exemplary construction each of the rail legs 40 also may include a downwardly projecting finger 56 forming a free end which intersects with a main portion of the rail leg at a corner 58. As will be appreciated, the downwardly projecting fingers may be used to engage the ridge 48 or other surface structures on the lower portion of the head 16 during assembly.

As best seen in FIG. 3, in the illustrated exemplary construction an ear 66 may extend downwardly from each lower corner of the support collar 32. As will be appreciated, the ears 66 may provide a stop surface to limit the degree of sliding engagement of the cover 28 over the head 16. Thus, the ears 66 may prevent sliding the cover too far in the direction of the proximal end of the flashlight head 16. If desired, the ears may also be provided with eyelet openings 68 which may be used for tethering to a lanyard or strap (not shown) to avoid loss of the cover when not in use.

Figure 8:
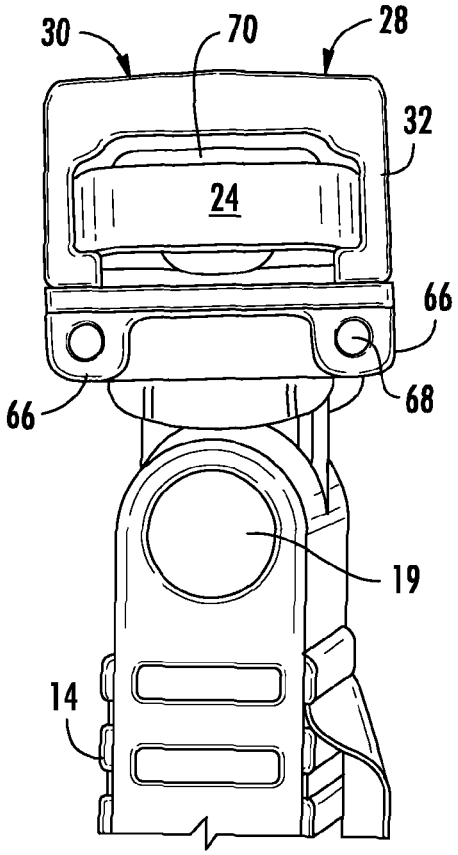
FIG. 8 is a distal edge view of the exemplary cover in the attached condition on the exemplary flashlight.
Figure 9:
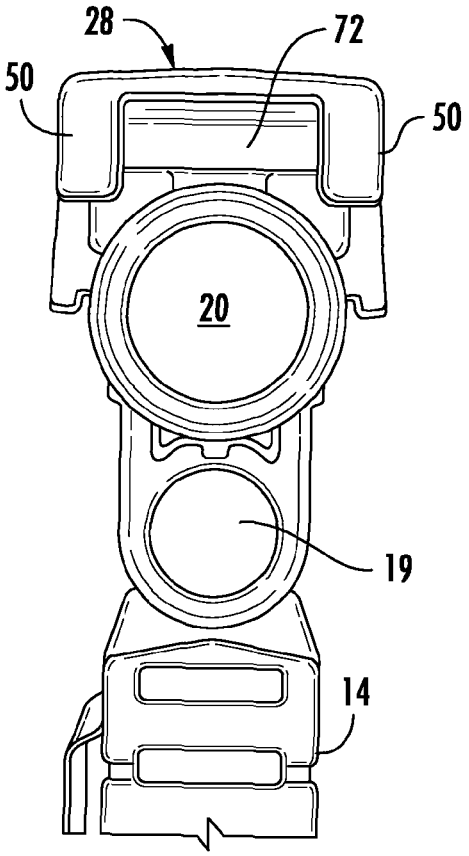
FIG. 9 is a proximal edge view of the exemplary cover in the attached condition on the exemplary flashlight.

As best seen in FIG. 7, in the final assembled condition, the gaps 43 below the platform 30 provides a pair of lateral, light emitting openings between the platform 30 and the upper surface of the barrier wall 24. Moreover, as best seen in FIGS. 8 and 9, slot openings 70, 72 are present between the platform 30 and the upper edge of the bather wall 24 at the distal and proximal ends of the cover. Thus, in the final assembled condition with the cover 28 in place, the slot openings 70, 72 at the distal and proximal ends may cooperate with the gaps 43 along the lateral sides to form an arrangement of radially projecting light-emitting openings extending substantially around the perimeter of the flashlight head 16.

Once the assembled condition illustrated in FIG. 7 has been achieved, the underside of the platform 30 acts to at least partially block the light beam emitted by the flashlight head 16. As the light beam is blocked, a portion of the beam is reflected off the underside of the platform so as to project through the collective perimeter slot openings between the flashlight head 16 and the platform 30. In this regard, it is contemplated that the underside of the platform 30 may be naturally reflective or a reflective coating may be added if desired. It is also contemplated that the platform 30 may only partially block the light beam emitted by the flashlight head 16. By way of example only, an not limitation such partial blocking may be performed by techniques such as including one or more openings in the platform 30, using a platform 30 which is narrower than the light beam or positioning the platform 30 slightly out of alignment with the light beam.

As will be appreciated, with light being deflected radially by the cover 28, a relatively wide field of illumination may be established even if the initial light beam is directionally concentrated. In this condition, the illumination field is wider, although the degree of illumination tends to be less intense. By way of example only, and not limitation, such a wide field of illumination may be desirable for purposes such as illuminating a hiking path where breadth of illumination is more important than intensity.

As noted previously, the deflection of the light beam may be reversed simply by removing the cover 28. Such removal may be carried out by simply lifting the end of the platform 30 upward with a flexing motion and then pushing the cover off the flashlight head 16.

Of course, variations and modifications of the foregoing are within the scope of the present disclosure. Thus, it is to be understood that the disclosure disclosed and defined herein extends to all alternative combinations of two or more of the individual features mentioned or evident from the text and/or drawings. All of these different combinations constitute various alternative aspects of the present disclosure.

What is claimed is:

1. A light dispersing flashlight cover adapted for selective attachment to a flashlight having an articulating head and a barrier wall disposed about a lens, the cover comprising:

a support collar adapted to at least partially surround a distal portion of the barrier wall extending radially outwardly from the lens such that the distal portion of the barrier wall is at least partially edged by the support collar;

a platform extending away from the support collar, wherein the platform is supported in resilient cantilevered relation to the support collar and extends away from the support collar such that the platform is disposed in overlying, raised relation to at least a portion of the lens when the support collar at least partially surrounds the distal portion of the barrier wall such that a light beam emitted through the lens is at least partially blocked by the platform and is dispersed radially relative to the lens; and a pair of spaced-apart lateral rail legs extending away from the support collar in the same direction as the platform, the rail legs being disposed at an elevation below the platform to define a gap between the platform and the rail legs.

2. The light dispersing flashlight cover as recited in claim 1, wherein the cover is a polymeric molded structure of unitary construction.

3. The light dispersing flashlight cover as recited in claim 1, wherein a pair of catch arms extend downwardly away from a free end of the platform remote from the support collar, the catch arms being adapted to engage a proximal portion of the barrier wall when the support collar at least partially surrounds the distal portion of the barrier wall.

4. The light dispersing flashlight cover as recited in claim 3, wherein the catch arms each include a stepped interior surface with a finger portion extending away from a shoulder.

5. The light dispersing flashlight cover as recited in claim 1, wherein the platform includes a central panel with a plurality of alternating depressions and raised ribs disposed outboard from the central panel along lateral sides of the platform.

6. The light dispersing flashlight cover as recited in claim 1, wherein the platform is resiliently anchored at the support collar.

7. The light dispersing flashlight cover as recited in claim 1, wherein each of the rail legs includes a downwardly projecting finger at a free end remote from the support collar.

8. The light dispersing flashlight cover as recited in claim 1, wherein the rail legs extend along a line substantially parallel to the platform.

9. The light dispersing flashlight cover as recited in claim 1, further comprising a pair of opposing groove-engaging ears projecting radially inwardly away from opposing surfaces, the groove-engaging ears each being adapted to slidingly engage an opposing groove on the articulating head.

10. A light dispersing flashlight cover adapted for selective attachment to a flashlight having an articulating head and a barrier wall disposed about a lens, the cover comprising:

a support collar adapted to at least partially surround a distal portion of the barrier wall extending radially outwardly from the lens such that the distal portion of the barrier wall is at least partially edged by the support collar, the support collar comprising a pair of opposing lateral posts extending upwardly from a lower crossing support;

a platform integral with the support collar and having a free end extending away from the support collar, wherein the platform is supported in resilient cantilevered relation to the support collar and extends away from the support collar such that the platform is disposed in overlying, raised relation to at least a portion of the lens when the support collar at least partially surrounds the distal portion of the barrier wall such that a light beam emitted through the lens is at least partially blocked by the platform and is dispersed radially relative to the lens;

a pair of spaced-apart lateral rail legs integral with the support collar and extending away from the lateral posts of the support collar in the same direction as the platform, the rail legs being disposed at an elevation below the platform to define a gap between the platform and the rail legs; and a pair of opposing groove-engaging ears projecting radially inwardly away from opposing interior surfaces of the support collar, the groove-engaging ears each being adapted to slidingly engage an opposing groove on the articulating head.

11. The light dispersing flashlight cover as recited in claim 10, wherein the cover is a polymeric molded structure of unitary construction.

12. The light dispersing flashlight cover as recited in claim 10, wherein a pair of catch arms extend downwardly away from a free end of the platform remote from the support collar, the catch arms being adapted to engage a proximal portion of the barrier wall when the support collar at least partially surrounds the distal portion of the barrier wall.

13. The light dispersing flashlight cover as recited in claim 12, wherein the catch arms each include a stepped interior surface with a finger portion extending away from a shoulder.

14. The light dispersing flashlight cover as recited in claim 10, wherein the platform includes a central panel with a plurality of alternating depressions and raised ribs disposed outboard from the central panel along lateral sides of the platform.

15. The light dispersing flashlight cover as recited in claim 10, wherein the platform is resiliently anchored at the support collar.

16. The light dispersing flashlight cover as recited in claim 10, wherein each of the rail legs includes a downwardly projecting finger at a free end remote from the support collar.

17. The light dispersing flashlight cover as recited in claim 16, wherein the rail legs each extend along a line substantially parallel to the platform.

18. A light dispersing flashlight cover adapted for selective attachment to a flashlight having an articulating head and a barrier wall disposed about a lens, the cover comprising:

a support collar adapted to at least partially surround a distal portion of the barrier wall extending radially outwardly from the lens such that the distal portion of the barrier wall projects through the support collar, the support collar comprising a pair of opposing lateral posts extending upwardly from a lower crossing support, a platform integral with the support collar, the platform having a free end extending away from the support collar, wherein the platform is supported in resilient cantilevered relation to the support collar and extends away from the support collar such that the platform is disposed in overlying, raised relation to at least a portion of the lens when the support collar at least partially surrounds the distal portion of the barrier wall such that a light beam emitted through the lens is at least partially blocked by the platform and is dispersed radially relative to the lens, wherein a pair of catch arms extend downwardly away from the free end of the platform, the catch arms having a stepped interior surface with a finger portion extending away from a shoulder;

a pair of spaced-apart lateral rail legs extending away from the lateral posts of the support collar, the rail legs being disposed at an elevation below the platform to define a gap between the platform and the rail legs, each of the rail legs including a downwardly projecting finger at a free end; and a pair of opposing groove-engaging ears projecting radially inwardly away from opposing interior surfaces of the lateral posts of the support collar, wherein the groove-engaging ears are disposed at an elevation between the platform and the lateral rail legs, the groove-engaging ears each being adapted to slidingly engage an opposing groove on the articulating head.

19. The light dispersing flashlight cover as recited in claim 18, further comprising a pair of ears defining stop elements projecting downwardly away from the support collar.

* * * * *